US008662626B2

(12) United States Patent
Kahl et al.

(10) Patent No.: US 8,662,626 B2
(45) Date of Patent: Mar. 4, 2014

(54) DEVICE AND METHOD FOR CONTROLLING THE TENSION OF A SUBSTRATE WEB

(75) Inventors: Dirk Kahl, Preetz (DE); Karlheinz Peter, Molfsee (DE); Rolf Spilz, Gettorf (DE); Ulrich Schmidt, Preetz (DE); Matthias Wecker, Bebra-Asmushausen (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/512,039

(22) PCT Filed: Nov. 18, 2010

(86) PCT No.: PCT/EP2010/067760

§ 371 (c)(1),
(2), (4) Date: Sep. 19, 2012

(87) PCT Pub. No.: WO2011/064136

PCT Pub. Date: Jun. 3, 2011

(65) Prior Publication Data

US 2013/0010024 A1 Jan. 10, 2013

(30) Foreign Application Priority Data

Nov. 30, 2009 (DE) ..... 10 2009 056 293

(51) Int. Cl.
*B41J 29/393* (2006.01)

(52) U.S. Cl.
USPC ..... 347/19

(58) Field of Classification Search
USPC ..... 347/4, 5, 19
See application file for complete search history.

(56) References Cited

U.S. PATENT DOCUMENTS

| | | | | |
|---|---|---|---|---|
| 4,004,510 | A | 1/1977 | Roch | |
| 5,485,386 | A | 1/1996 | Andreasson | |
| 7,857,414 | B2 * | 12/2010 | Eun et al. | 347/19 |
| 8,376,501 | B2 * | 2/2013 | Dejong et al. | 347/19 |
| 2005/0167460 | A1 | 8/2005 | Franz et al. | |
| 2007/0131036 | A1 | 6/2007 | Schultze | |
| 2009/0039130 | A1 | 2/2009 | Schultze et al. | |
| 2009/0145943 | A1 | 6/2009 | Schnabel et al. | |
| 2010/0089962 | A1 | 4/2010 | Mehlis et al. | |

* cited by examiner

*Primary Examiner* — Lamson Nguyen
(74) *Attorney, Agent, or Firm* — Christopher J. White

(57) ABSTRACT

A device for controlling substrate web tension includes first and second driving units with respective driving rollers around which the substrate web is partially guided and tensioned. The first and second driving units have different rotational moments of inertia. A measuring unit measures the tension of the substrate web. A control unit has first and a second filtering units with different filtering characteristics for filtering the measured value. The control unit includes a first control device for controlling the first driving unit based on the measured value filtered by the first filtering device, and a second control device for controlling the second driving unit based on the measured value filtered by the second filtering device.

14 Claims, 3 Drawing Sheets

DEVICE AND METHOD FOR CONTROLLING THE TENSION OF A SUBSTRATE WEB

TECHNICAL FIELD OF THE INVENTION

The present invention relates to a device and a method for controlling the tension of a substrate web, said substrate web being conveyed along a transport path.

BACKGROUND OF THE INVENTION

A plurality of machines for processing substrate webs, for example, paper webs or fabric webs is known. These processing machines can perform a multitude of process steps on the substrate web such as, for example, printing, embossing or cutting. Most process steps require that the substrate web display a tension that is as uniform as possible. If the substrate web is not tensioned uniformly, process errors may occur in the substrate web such as, for example, shifts of printed images, as well as tears or creases. In order to maintain a uniform tension of the substrate web such processing machines comprise tensile stress control arrangements.

In particular in multi-color printing machines, it is necessary that the substrate web tension of a substrate web be controlled as accurately as possible in order to enable printing in a register-perfect manner. The description hereinafter thus refers to the example of a printing machine in greater detail; however, it should be noted that both the device, as well as the method for controlling the substrate web tension, can be used with other processing machines.

A known design of a tensile stress control device comprises a force-measuring box that measures the tension of the substrate web and emits a corresponding measuring signal. The measuring signal is used for the control of an associate driving unit.

Depending on the size of the driving unit that is used for controlling the tensile stress, there are limits regarding the disturbances of the substrate web tension that can be corrected by the driving system. However, the remaining errors and fluctuations are not acceptable, in particular in the case of printing machines because said errors and fluctuations can seriously compromise the printed image.

For example, in reel fed printing machines there are existing strict requirements regarding the achievable tensile stress and the allowed tensile stress errors. It is impossible to meet these requirements with the aforementioned conventional method, wherein a tensile stress control is based on a not specifically processed measured value from force-measuring boxes.

With regard to the dimensioning of drive and control of a printing machine, in most cases the problem occurs that an electric motor with strong torque is necessary for the required mean substrate web tension. However, the rotors of these motors display large moments of inertia and long coil delay times that make it difficult to correct high-dynamic disturbances of the substrate web tension. Here the coil delay time is understood as the ratio of coil inductance to coil resistance. Conversely, it can be said that small electric motors displaying a small moment of inertia of the rotor and low coil delay times provide the dynamics necessary for correcting the highly dynamic disturbances but cannot provide the required torque.

SUMMARY OF THE INVENTION

It is, therefore, an object of the invention to create a control device and a control method that make it possible to avoid the aforementioned problems.

This object is achieved with devices and methods.

In particular, the device for controlling the tension of a substrate web, said web being conveyed along a transport path, comprises a first driving unit with a first driving roller around which the substrate web is partially guided and tensioned, and comprises a second driving unit with a second driving roller around which the substrate web is partially guided and tensioned. The first and the second driving units feature different rotational moments of inertia. Further provided are a measuring unit for providing a measured value of the tension of the substrate web and a control unit in connection with said measuring unit and said first and second driving units, said control unit comprising a first and a second filtering unit displaying different filtering characteristics for filtering the measured value. The control unit comprises a first control device for controlling the first driving unit based on the measured value filtered by the first filtering unit, as well as a second control device for controlling the second driving unit based on the measured value filtered by the second filtering unit. Thus, the driving units can be activated in a manner that has been advantageously adapted to the dynamic behavior that is affected by the rotational moments of inertia of said driving units.

Preferably, the filtering units comprise, respectively, a low-pass filter and a high-pass filter. Consequently, a driving unit with a small rotational moment of inertia can compensate for rapid tension changes measured with the use of a measured value filtered with the high-pass filter, and a driving unit with a large rotational moment of inertia can compensate for slow tension changes measured with the use of a measured value filtered with the low-pass filter.

In one exemplary embodiment of the device, at least one of the filtering units displays a filtering characteristic that depends on the conveying speed of the substrate web along the transport path. Thus, different dynamic behaviors of the driving units in the different speed ranges can be taken into consideration when said driving units are being activated.

In one exemplary embodiment of the device, the first driving unit displays a higher rotational inertia than the second driving unit. This is the case if, on the one hand, a heavy driving unit displaying high torque capacity is used and, on the other hand, a light-weight driving unit displaying low torque capacity is used. In this manner, it is possible to correct fast and slow disturbance values of the substrate web tension.

Furthermore, a printing machine is disclosed that, in addition, comprises a main drive for conveying a substrate web along a transport path, at least one printing unit and a device for controlling the tension of the substrate web in accordance with one of the aforementioned embodiments. The main drive prespecifies the process speed or printing speed.

Preferably, the control unit of the device for controlling the substrate web tension communicates with the main drive of the printing machine. Thus, a printing speed or process speed generated by the main drive can be taken into consideration during the control operation.

In the printing machine, the measuring unit of the device for controlling the tension of the substrate web is advantageously arranged between the second driving unit and the main drive—viewed in the direction of the transport path.

Preferably, the printing machine comprises a control unit for controlling the main drive, said control unit controlling a printing speed generated by the main drive. Thus, the printing speed can be generated by a powerful main drive, and disturbances of the substrate web tension can be corrected by the dynamic driving units.

Furthermore, the objects of the invention are achieved by a method for controlling the tension of a substrate web, wherein the substrate web is at least partially guided and conveyed around a first and a second driving roller that feature different rotational moments of inertia.

This method comprises the following steps: measuring the tension of the substrate web and generating a measured value as a function of said tension; parallel filtering of the measured value in a first and in a second filtering unit displaying different filtering characteristics; controlling the first driving unit depending on the measured value filtered by the first filtering unit; and controlling the second driving unit depending on the measured value filtered by the second filtering unit. Thus, the measured value is simultaneously used as the control value for two different driving units and is, for this purpose, processed with respect to the dynamic characteristics of the driving units.

Preferably, the step of filtering the measured value comprises low-pass filtering and high-pass filtering so that fast and slow disturbances of the substrate web tension can be corrected by a fast-responding driving unit and by a slow-responding driving unit, respectively.

Advantageously, the method comprises conveying the substrate web by means of a main drive along the transport path. This means that the printing speed is generated by a main drive using a simple control, and disturbances of the substrate web tension can be corrected by the first and second driving units.

In one exemplary embodiment of the method, the step of filtering the measured value occurs depending on a conveying speed of the substrate web along the transport path, so that any different dynamic behavior of the driving units in different speed ranges can be taken into account.

With the method, preferably a nominal tension of the substrate web is taken into consideration regarding the control of the first driving unit. Furthermore, an offset preferably is taken into consideration regarding the control of the second driving unit.

The invention, as well as additional details thereof, will be explained in detail hereinafter with the use of exemplary embodiments and with reference to the figures.

DETAILED DESCRIPTION OF THE INVENTION

It should be noted that the terms top, bottom, right and left, as well as similar directions used in the description hereinafter, relate to alignments or arrangements shown in the figures and are only intended for describing the exemplary embodiments. However, these expressions must not be understood to have a restrictive meaning.

Figure 1:
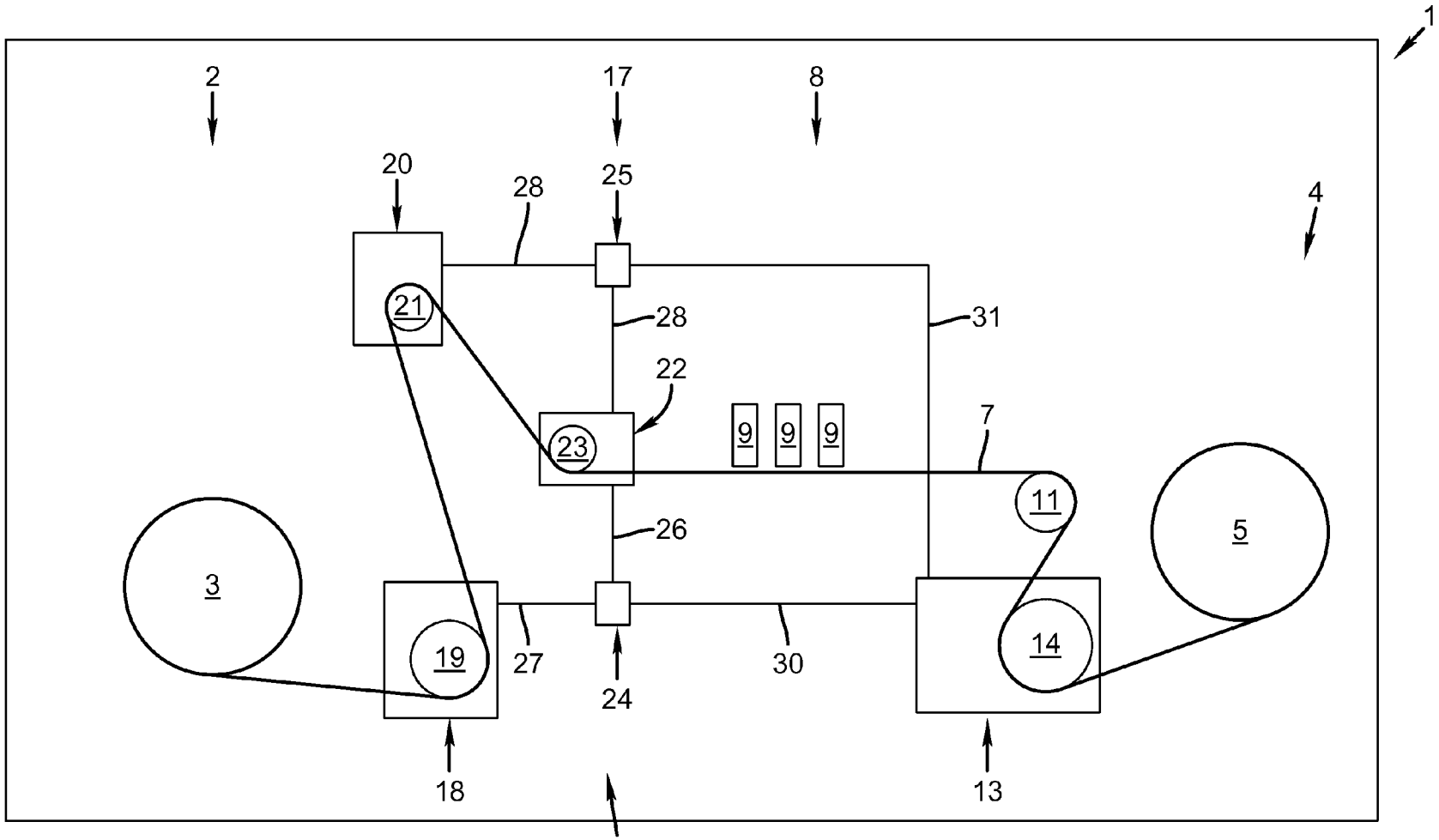
FIG. 1 is a schematic side view of a printing machine, said printing machine comprising a device for controlling the tension of a substrate web.

FIG. 1 shows a schematic side view of a printing machine 1 as an example of a processing machine. The printing machine 1 comprises a feeder 2 with a first substrate web roll 3 and an output unit 4 with a second substrate web roll 5. A substrate web 7 extends along a transport path from the first substrate web roll 3 to the second substrate web roll 5. Between the feeder 2 and the output unit 4 and along the transport path of the substrate web 7, there is a printing region 8 with several printing stations 9 for different colors being arranged in said printing region. The substrate web 7 is also guided in the printing machine 1 over at least one deflecting roller 11 in order to define the transport path and the wrap angle, these enabling a reliable transmission of the driving torques of the rollers to the substrate web 7. Furthermore, the printing machine 1 comprises a main driving unit 13 with a main driving roller 14, the latter being intended for conveying the substrate web 7 from the first substrate web roll 3 in the direction toward the second substrate web roll 5.

Furthermore, the printing machine 1 comprises a tension control device 16 that is arranged between the first substrate web roll 3 in the feeder 2 and the printing region 8 comprising the print heads 9. The tension control device 16 comprises a control unit 17, a first driving unit 18 with a first driving roller 19, and a second driving unit 20 with a second driving roller 21, as well as a measuring unit 22 with a measuring roller 23. It should be noted that the measuring unit 22 may also be designed without measuring roller, said unit being able to measure the tension of the substrate web 7. The first driving roller 19, the second driving roller 21 and the measuring roller 23 are arranged in such a manner that the substrate web extends in the form of an S-shaped loop around the rollers 19, 21 and 21, 23.

The control unit 17 of the tension control device 16 comprises a first control device 24 for controlling the first driving unit 18 as well as a second control device 25 for controlling the second driving unit 20. For easier explanation, the first and the second control devices 24 and 25 are shown as separate control devices in FIGS. 1 and 2; however, in practical applications, they may also be components of a control unit, said unit controlling a multitude of processes of the printing machine 1.

A signal line 26 is disposed to connect the measuring unit 22 with the first control device 24 which, in turn, is connected with the associate driving unit 18 via an additional signal line 27. In the same manner, the measuring unit 22 is connected—via a signal line 28—with the second control device 25 which, in turn, is connected with the associate second driving unit 20 via a signal line 29. The main driving unit 13 is connected with the first control device 24 via a signal line 30 and is further connected with the second control device 25 via a signal line 31.

Figure 2:
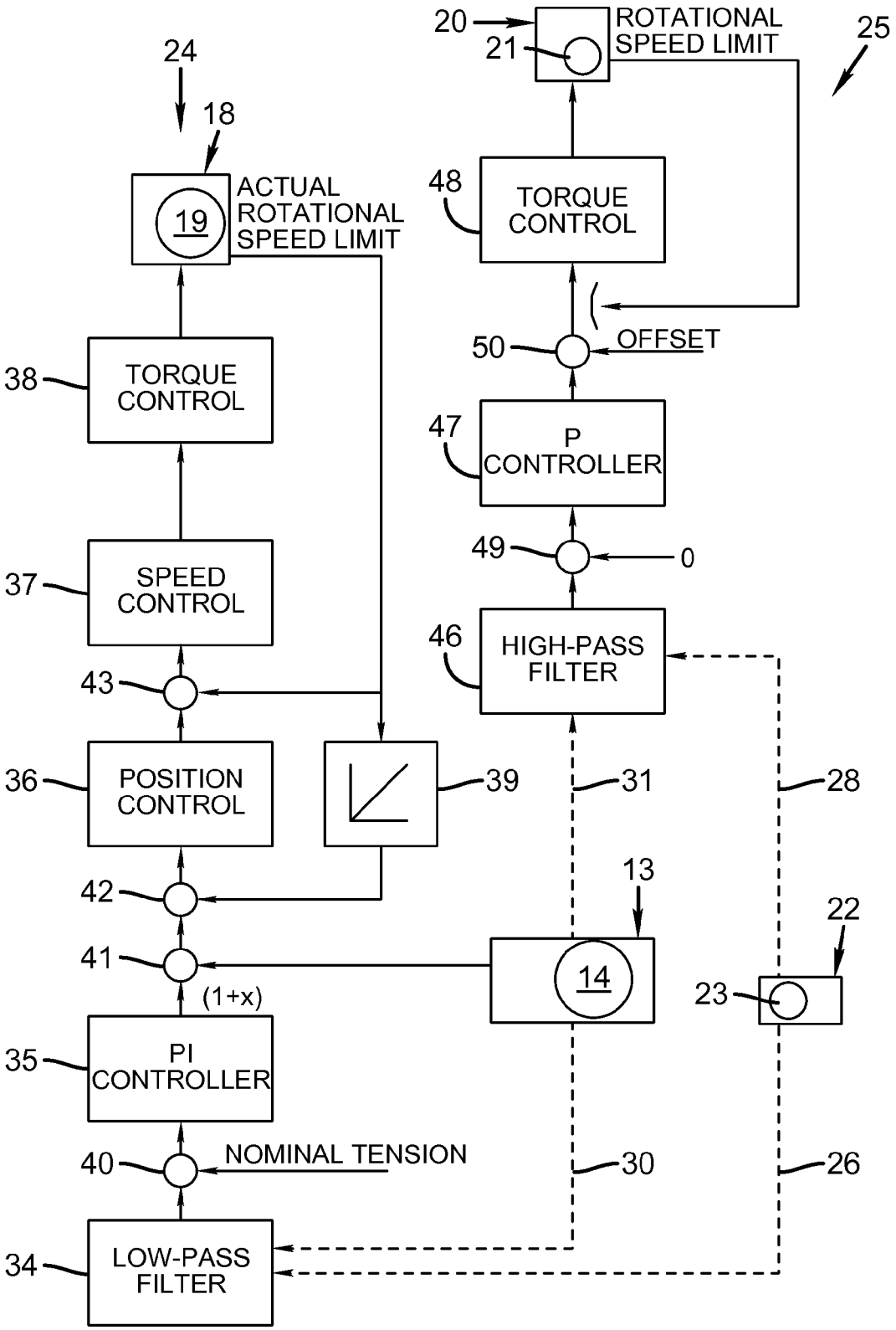
FIG. 2 is a schematic of the control system of the device for controlling the tension of a substrate web.

FIG. 2 shows, in detail, the design of the first and second control devices 24, 25. The first control device 24 for the first driving unit 18 comprises a low-pass filter block 34, a PI controller block 35, a position control block 36, a speed control block 37, a torque control block 38, as well as a function or mapping block 39. An input of the low-pass filter block 34 is connected with an output of the measuring unit via the signal line 26, in order to receive a measured value that is in relation to the measured tension of the substrate web 7. Between the low-pass filter block 34 and the PI controller block 35 there is arranged a node 40, wherein a nominal tension, as well as the negative output signal of the low-pass filter block, are combined and transmitted to the PI controller block 35. Between the output of the PI controller block 35 and the input of the position control block 36, there are sequentially arranged two nodes 41, 42. At node 41, the output signal of the PI controller block 35, said signal having been processed by the function (1+X), as well as a speed signal from the main driving unit 13 are combined and transmitted further to the subsequent node 42. At node 42, the output signal of the node 41, as well as a negative output signal of the mapping block 39 are combined and transmitted to the input of the position control block 36. Another node 43 is arranged between the position control block 36 and the speed control block 37. At the node 43, an output value of the position control block 36, as well as an actual rotational speed signal of the motor, said signal having a negative sign, are combined by the first driving unit 18 and are transmitted to the input of the speed control block 37. The output of the speed control block 37 is connected with the input of the torque control block 38. The output of the torque control block 38 is connected with the first driving unit 18.

The second control device 25 comprises a high-pass filter block 46, a P controller block 47, as well as a torque control block 48. The output of the measuring unit 22 to which the measured value based on the substrate web tension is applied, is connected with the input of the high-pass filter block 46 via the signal line 28. A node 49 is arranged between the high-pass filter block 46 and the P controller block 47. At the node 49, a value of 0, as well as a negative output signal of the high-pass filter block 46 are combined and transmitted to the input of the P controller block 47. Another node 50 is arranged between the output of the P controller block 47 and the input of the torque control block 48. At node 50, the output value of the P controller block 47 and an offset are combined and transmitted to the input of the torque control block 48. A rotational speed limit tapped from the second driving unit 20 is transmitted to the input of the torque control block 48 in order to act there on the input value into the torque control block 48. The output of the torque control block 48 is connected with the second driving unit 20.

The main driving unit 13 is connected with the low-pass filter block 34 via signal line 30 and is connected with the high-pass filter block 46 via signal line 31. Thus, depending on the control pattern, the filtering characteristics of the low-pass filter block 34 or the high-pass filter block 46 can be adjusted depending on the process speed or printing speed of the main driving unit 13. It should be noted that the connection of the main driving unit 13 with the high-pass and low-pass filter blocks 34, 46 of the first and second control devices 24, 25 is not absolutely necessary.

Figure 3:
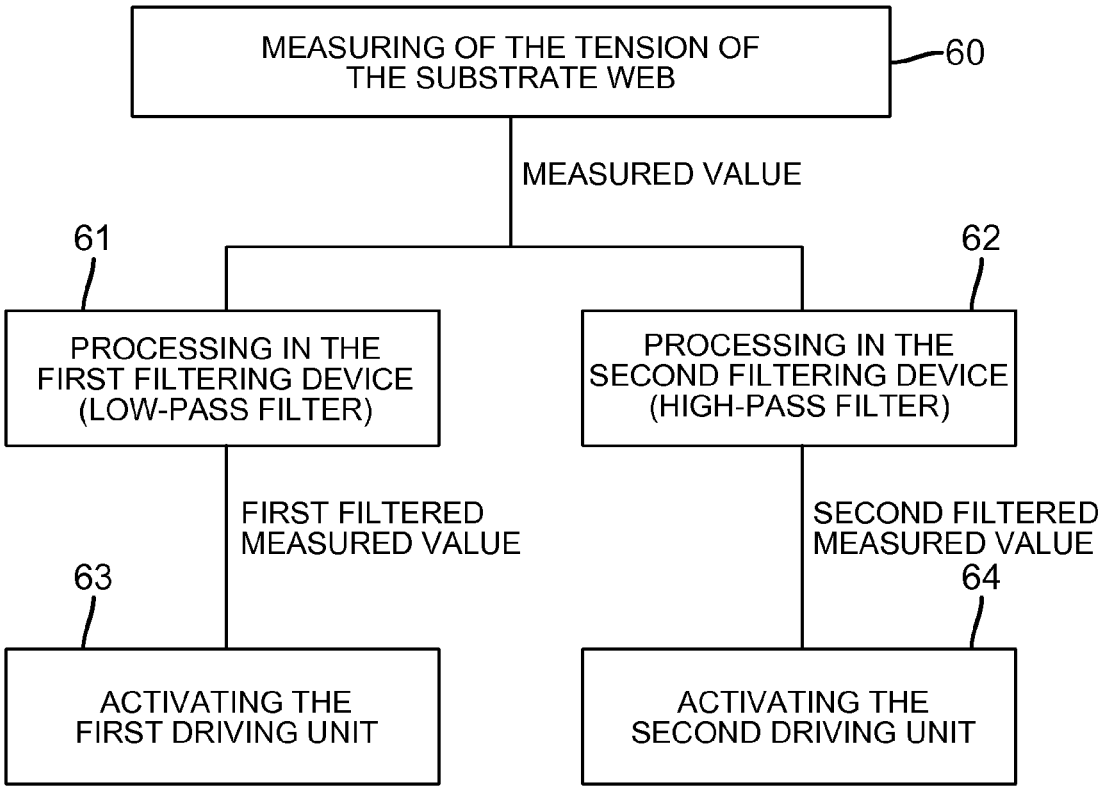
FIG. 3 is a flow chart showing the process of a method for controlling the tension of a substrate web.

With reference to FIG. 3, the basic design of the control method is described hereinafter in greater detail with the tension control device 16 in operative position. In this method, the tension of the substrate web 7 is basically measured with the aid of a measuring unit 22, and its measured value is processed further in different filtering devices and used for controlling the first and second driving units.

To put it more precisely, the tension of the substrate web 7 is measured with the aid of the measuring unit 22 in step 60. The output signal resulting therefrom or the measured value of the measuring unit 22 is then transmitted parallel to the low-pass filter block 34 being the first filtering unit (step 61) and also to the high-pass filter block 46 being the second filtering unit (step 62). A first filtered measured value results from the processing operation in the low-pass filter unit 34, said first filtered measured value being used for controlling the first driving unit 18 (step 62). A second filtered measured value results from the processing operation in the high-pass filter block 46, said second filtered measured value being used for controlling the second driving unit 20 (step 64).

As is obvious from FIG. 2, the instantaneous printing speed or process speed is additionally transmitted from the main driving unit 13—via the signal lines 30, 31—to the low-pass filter block 34 as well as also to the high-pass filter block 46. The filtering characteristics of the low-pass filter block 34 or the high-pass filter block 46 are then adjusted based on the process speed, for example, as a function of a mapping field, a function, or as a function of a prespecified setting. The dynamic behavior of the first and the second driving units can be changed depending on the process speed. However, it should be noted that the signal lines 30, 31 and the adjustment of the filtering characteristics that depends on the process speed are not necessary for each embodiment.

Processing of the first filtered measured value as the output value of the low-pass filter block 34 will now again be described in more detail with reference to FIG. 2. The first filtered measured value is given a negative sign and transmitted to the node 40 of the first control device 24. At the node 40, the first filtered measured value is added to a prespecified nominal tension, and the result is transmitted as the input value into the PI controller block 35 and processed there. The output value of the PI controller block 35 is processed using the function (1+x) and transmitted to the node 41 of the first control device 24. The node 41 also receives a speed signal from the main drive 13. The output value of the node 41 is then transmitted further to the node 42. The actual rotational speed of the motor is continually tapped from the first driving unit 18 and transmitted to the function or mapping block 39. In the mapping block 39, the actual rotational speed of the motor is changed in accordance with a mapping field, a function or a look-up table, and is also transmitted—as the changed actual rotational speed of the motor with a negative sign—to the node 42. In node 42, the changed negative actual rotational speed of the motor is combined with the output value of the node 41 and transmitted as the input value into the position control block 36 and processed there. The output value of the position control block 36 is transmitted to the node 43, with the actual rotational speed of the motor of the first driving unit having a negative sign also being transmitted to said node. The negative actual rotational speed of the motor and the output value from the position control block 36 are combined in node 43 and entered as the input value in the speed control block 37 and processed there. The output value resulting from the speed control block is transmitted directly as the input value into the torque control block 38. The torque control block 38 processes this input value, ultimately transmitting said input value to the first driving unit 18.

Now, processing of the measured value of the measuring unit 22 in the second control device 25 will also be described in greater detail with reference to FIG. 2. The output value or measured value of the measuring unit 22 is transmitted to the input of the high-pass filter block 46 and processed therein. The output value of the high-pass filter block 46 is given a negative sign and transmitted to the node 49. The node 49 also picks up a control value "0" and transmits the value resulting from the two input values as the input value to the P controller block 47, where the input value is processed. The output value exiting from the P controller block is combined with a prespecified offset at node 50 and made available as the input value to the torque control block 48. However, before the combined offset and the output value of the P controller block 47 are used as the input value for the torque control block 48, there is a check to determine whether this input value for the torque control block 48 exceeds the rotational speed limit that is being tapped from the second driving unit 20. If the rotational speed limit is exceeded, the input value for the torque control block 48 is limited. If the rotational speed limit is not exceeded, the input value is made available to the torque control block 48 without any further change. The torque control block 48 processes this input value and outputs its output value to the second driving unit 20.

In summary, it can be said that the measured signal of a measuring unit is first split and then filtered separately, and then subjected to separate signal processing in order to find its use in the control of different driving units. Thus, the measured signal is used, at the same time, as a as a control value for two different driving units and is processed, for this purpose, in view of the dynamic characteristics of the driving units.

In the practical application in a reel fed printing machine displaying a printing speed of 0.13 m/sec to 2.5 m/sec, a substrate web tension on the order of 120 to 550 N with a tolerance of 1% is generated with the aid of the presented device and the method for controlling the substrate web tension shown here.

The invention has been described with reference to a preferred exemplary embodiment, wherein individual features of the described exemplary embodiment may be left out, unless they are absolutely necessary. For the person skilled in the art, there are numerous possible and obvious modifications and embodiments, without departing from the invention.

PART LIST

FIG. 1:
1 Printing machine
2 Feeder
3 Web roll
4 Output unit
5 Web roll
7 Substrate web
8 Printing region
9 Printing station
11 Deflecting roller
13 Main driving unit
14 Driving roller
16 Tension control device
17 Control unit
18 First driving unit
19 First driving roller
20 Second driving unit
21 Second driving roller
22 Measuring unit
23 Measuring roller
24 First control device
25 Second control device
26 Signal line
27 Signal line
28 Signal line
30 Signal line
FIG. 2:
19 Actual rotational speed limit
21 Rotational speed limit
48 Torque control
38 Torque control
50 Offset
47 P Controller
37 Speed control
46 High-pass filter
36 Position control
35 PI Controller
40 Nominal tension
34 Low-pass filter
FIG. 3:
60 Measuring of the tension of the substrate web Measured value
61 Processing in the first filtering device (low-pass filter)
62 Processing in the second filtering device (high-pass filter) First filtered measured value
63 Activating the first driving unit Second filtered measured value
64 Activating the second driving unit

The invention claimed is:

1. Device for controlling the tension of a substrate web that is conveyed along a transport path, the device comprising:
- a first driving unit with a first driving roller around which a substrate web is partially guided and tensioned;
- a second driving unit with a second driving roller around which the substrate web is partially guided and tensioned,
- with the first and the second driving units featuring different rotational moments of inertia;
- a measuring unit for delivery of a measured value of the tension of the substrate web;
- a control unit in connection with the measuring unit and the first and second driving units, the control unit comprising a first and a second filtering unit displaying different filtering characteristics for filtering the measured value,
- the control unit comprising a first control device for controlling the first driving unit based on the measured value filtered by the first filtering device, as well as a second control device for controlling the second driving unit based on the measured value filtered by the second filtering device.

2. The device according to claim 1, with the filtering devices comprising a low-pass filter or a high-pass filter.

3. The device according to claim 1, with at least one of the filtering devices displaying a filtering characteristic that depends on the conveying speed of the substrate web along the transport path.

4. The device according to claim 1, with the first driving unit displaying a higher rotational inertia than the second driving unit.

5. Printing machine comprising:
- a main drive for conveying a substrate web along a transport path;
- at least one printing unit; and
- a device for controlling the tension of the substrate web according to claim 1.

6. The printing machine according to claim 5, with the control unit of the device for controlling the substrate web tension being connected with the main drive of the printing machine.

7. The printing machine according to claim 5, with the measuring unit of the device for controlling the substrate web tension being arranged between the second driving unit and the main drive—viewed in the direction of the transport path.

8. The printing machine according to claim 5, the printing machine comprising a control unit for controlling the main drive, the control unit controlling the printing speed generated by the main drive.

9. Method for controlling the tension of a substrate web, wherein the substrate web is at least partially guided and conveyed around one first and one second driving rollers that feature different rotational moments of inertia, the method comprising:
- measuring the tension of the substrate web and generating a measured value as a function of the tension;
- parallel filtering of the measured value in a first and in a second filtering unit displaying different filtering characteristics;
- controlling the first driving unit as a function of the measured value filtered by the first filtering unit; and
- controlling the second driving unit as a function of the measured value filtered by the second filtering unit.

10. The method according to claim 9, wherein the step of filtering the measured value comprises a low-pass filtering or a high-pass filtering.

11. The method according to claim 9, wherein the substrate web is conveyed by a main drive along the transport path.

12. The method according to claim 9, wherein the step of filtering the measured value occurs depending on a conveying speed of the substrate web along the transport path.

13. The method according to claim 9, wherein a nominal tension of the substrate web is taken into consideration for the control of the first driving unit.

14. The method according to claim 9, wherein the offset is taken into consideration for the control of the second driving unit.

* * * * *